US005287656A

United States Patent [19]

Johnson

[11] Patent Number: 5,287,656

[45] Date of Patent: Feb. 22, 1994

[54] WEATHERSTRIP ASSEMBLY

[75] Inventor: Larry E. Johnson, Victor, N.Y.

[73] Assignee: Ultrafab Inc., Farmington, N.Y.

[21] Appl. No.: 52,023

[22] Filed: Apr. 22, 1993

[51] Int. Cl.[5] ..... E06B 7/16

[52] U.S. Cl. ..... 49/489.1

[58] Field of Search ..... 49/489.1, 475.1

[56] References Cited

U.S. PATENT DOCUMENTS

| | | | |
|---|---|---|---|
| 3,175,256 | 3/1965 | Horton | 20/69 |
| 3,213,584 | 10/1965 | Bush | 49/489.1 X |
| 3,224,047 | 12/1965 | Horton | 20/69 |
| 3,266,190 | 8/1966 | Jackson | 49/489 |
| 3,690,038 | 12/1972 | Dieterich | 49/489 |
| 4,148,953 | 4/1979 | Horton | 428/85 |
| 4,214,930 | 7/1980 | Burrous | 156/1 |
| 4,458,450 | 7/1984 | Young et al. | 49/489 |
| 4,687,127 | 8/1987 | Pardo et al. | 49/489.1 X |
| 5,060,422 | 10/1991 | Horton | 49/489.1 |
| 5,093,181 | 3/1992 | Sanchez | 49/489.1 X |

*Primary Examiner*—Philip C. Kannan
*Attorney, Agent, or Firm*—Martin Lu Kacher

[57] ABSTRACT

A weatherstrip assembly 8 for a window 6 includes a weatherstrip 20 with a backing strip 20 with pile fibers 22. The weatherstrip 20 is retained in a channel 10 of window 6. The channel 10 has a flexible wall 14 that is resilient and temporarily deformable to expand the cross-sectional area of channel 10 while the weatherstrip 20 is inserted into channel 10.

6 Claims, 3 Drawing Sheets

WEATHERSTRIP ASSEMBLY

BACKGROUND OF THE INVENTION

The present invention relates to weatherstrip assemblies, and, in particular, to weatherstrip assemblies which are used on windows and doors.

The invention is suitable for use with prime windows or doors as well as storm windows and storm doors. Those skilled in the art will appreciate that the invention is useful for other weatherstripping purposes.

Weatherstripping acts as a barrier or seal against the elements and prevents wind, rain and other elements from passing into a structure. This prevention is achieved through the use of an impervious barrier in the weatherstrip. A typical approach to solving problem of mounting a weatherstrip on a window or door structure has been to provide a channel in the periphery of the structure and an insertable strip that is retained in the channel. Early examples of such strip and channel combinations are shown in U.S. Pat. Nos. 3,224,047 and 3,226,190. More recent attempts at solving this problem have relied upon a flexible weatherstrip that can be deformed in order to insert it into a channel defined by relatively rigid structural members. So, for example, in U.S. Pat. No. 3,690,038, there is a shown weatherstrip member C with a cavity D. The weatherstrip member C is of flexible material and flanges 18 and 20 can be manipulated to temporarily reduce the size of the cavity D so that the weatherstrip member C may be inserted into a slot 10. Still others have provided lines of weakness along the backing strip member which can also assist in temporarily deforming the flexible weatherstrip or insertion into a T-slot. See, for example, U.S. Pat. No. 4,458,450.

It is a feature of this invention to provide an improved weatherstrip which in operation does not require a rigid channel member for retaining the flexible backing member.

It is a feature of the invention that the weatherstrip assembly includes a channel member for retaining the backing member and that the channel member has a flexible structure for temporarily altering the cross-sectional area of the retaining channel in order to accommodate a backing member having a rectangular cross-sectional area, and preferably, a square cross-sectional area.

The weatherstrip assembly of the invention has an elongated channel defined by a base and a pair of walls extending from the base and spaced apart. The channel defines a rectangular cross-sectional area with an opening opposite the base. At least one of the walls of the channel is resilient and flexible for temporarily expanding the cross-sectional area of the channel in order to permit a weatherstrip member to be inserted into or removed from the channel. The weatherstrip member includes a backing strip of rectangular cross-sectional area which is sufficiently large enough to fit snugly against the base and wall members of the channel. The backing strip has a row of pile fibers that extend longitudinally along its backing strip and project from the backing strip and through the opening of the channel.

Each wall of the channel has a lip and each lip is disposed at the opening of the channel. The lips extend toward one another and partially across the channel. The lips retain the backing strip in place by bearing against its upper surface. The lips are spaced far enough apart so that the pile fibers affixed to the upper surface of the backing strip project through the lips and out of the channel.

It is also envisioned that the invention may be incorporated into channels having more traditional T-slot cross sectional areas. In this case, the backing strip may be provided with a plurality of nubbins. The nubbins are distributed longitudinally along the length of the backing strip member and extend laterally from the backing strip. They extend far enough into the cross bar portion of the T-slot so that the lips of the T-slot overlap the nubbins and thereby retain the backing member in the T-slot.

DETAILED DESCRIPTION

Figure 1:
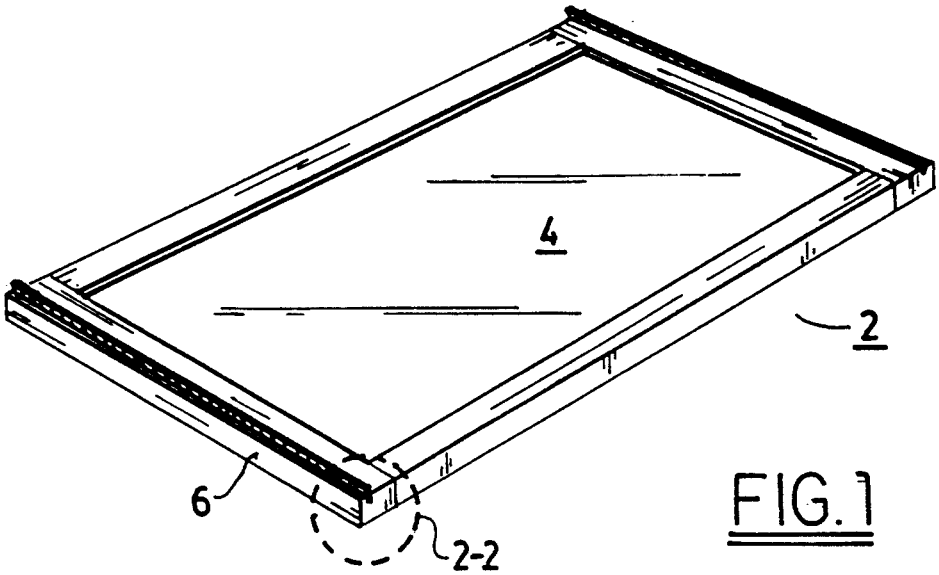
FIG. 1 is a perspective view of a window including the weatherstrip assembly of the invention.

With reference to FIG. 1, there is generally shown a window 2 having a pane of glass 4 or other translucent material encased in a frame that includes a longitudinal frame member 6.

Figure 2:
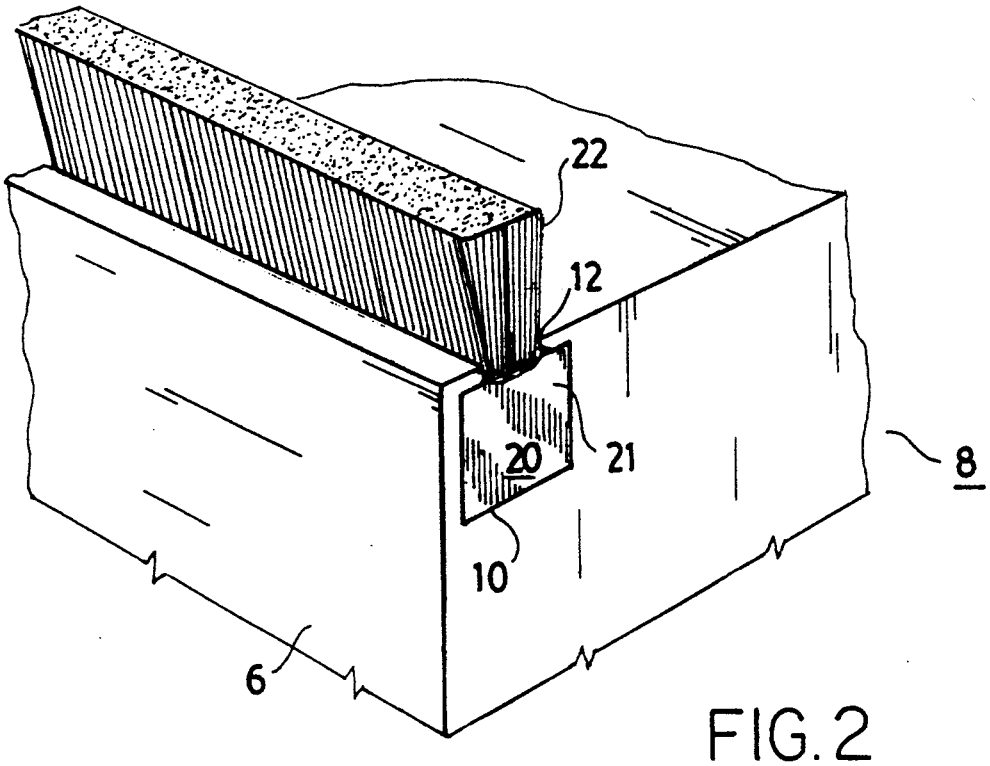
FIG. 2 is a partial perspective view of the section 2—2 indicated in FIG. 1.

As better shown in FIG. 2, a weatherstrip assembly 8 includes the frame member 6 has a channel 10 having a rectangular and preferably a square cross-sectional area extending the length of the frame member 6. Inside the channel 10 is a weatherstrip member 20 comprising a backing strip 21 of rectangular or square cross-section and a row of pile fibers 22 which extend longitudinally along the upper surface of backing strip and project through an opening 12 in the channel 10.

The pile members 22 are mounted on the backing strip member 21 to form the weatherstrip member 20 preferably in accordance with the method described in Horton patents U.S. Pat. Nos. 3,175,256 and 4,148,953 but may be in other manners known and used for weatherstrip fabrication. An example of a weatherstrip using a square backing with pile extending therefrom may be found in U.S. Pat. No. 4,214,930, FIG. 19 thereof.

Figure 3:
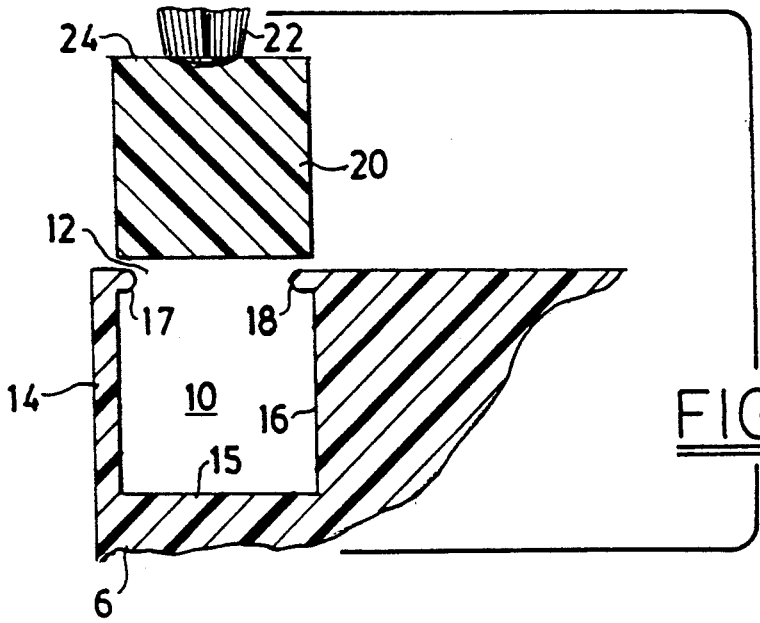
FIG. 3 is a partial cross-sectional view of the invention.

With reference to FIG. 3, the frame member 6 of the window 2 is comprised of a resilient and flexible material such as vinyl. The frame member 6 as channel 10 defined by walls 14, 16 that are spaced apart and extend vertically from a base 15. At the ends of the walls opposite the base 15 there are a pair of lips 17, 18. The lips 17, 18 project in a direction towards each other and thereby define opening 12 in the channel 10.

Figure 4:
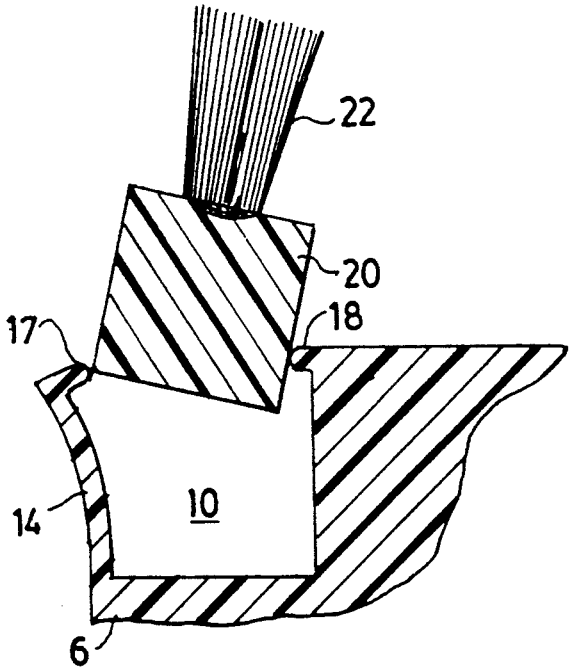
FIG. 4 is a partial cross-sectional view showing the weatherstrip member being inserted in the channel.
Figure 5:
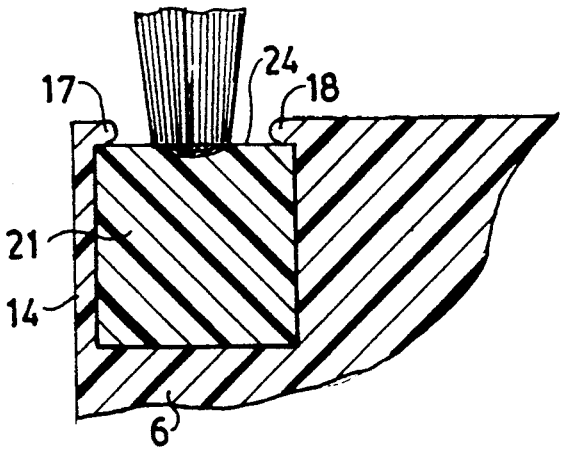
FIG. 5 is a partial cross-section view of the weatherstrip member in the channel.

In operation, the outer wall 14 is flexed outwardly as shown in FIG. 4 to thereby temporarily increase the cross-sectional area of the channel 10 and expand the opening 12 in order to permit the passage of the weatherstrip 20 into the channel 10. Once the weatherstrip 20 is fully inserted into the opening 10, the wall 14 returns to its original, vertical position and the lip 17 and 18 bear against the upper surface 24 of the backing strip 21 thereby retaining the backing strip 21 and the weatherstrip member 20 in the channel 10.

Figure 6:
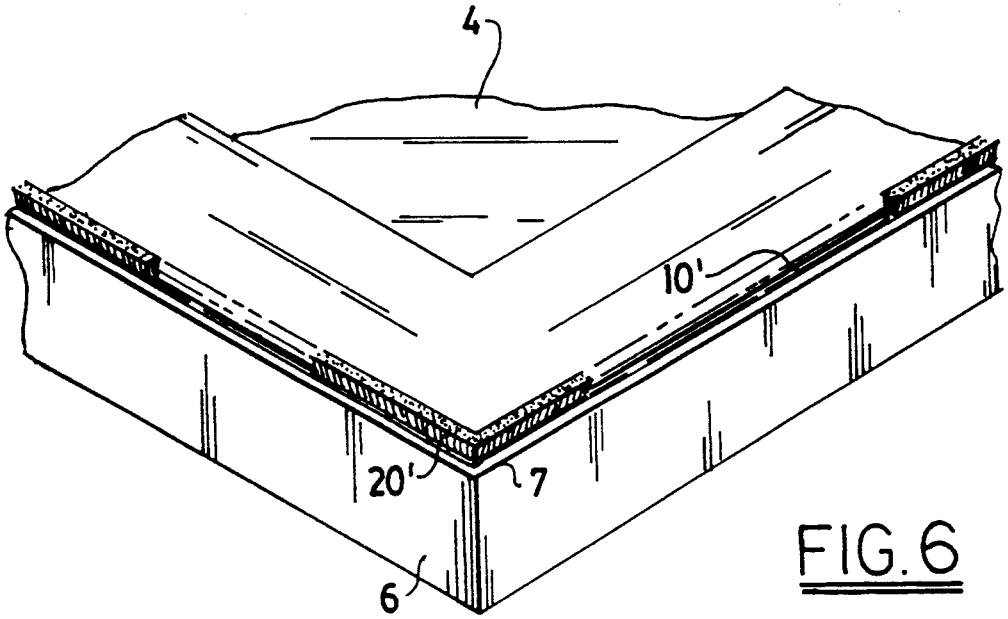
FIG. 6 is a partial perspective view showing the invention assembly applied around a corner of a window.

The weatherstrip assembly of the invention may also be provided around the entire periphery of the window 2. That particular application of the invention is shown in FIG. 6. There, the weatherstrip 20' is shown in a channel 10' that has a 90° turn at a corner 7.

Figure 7:
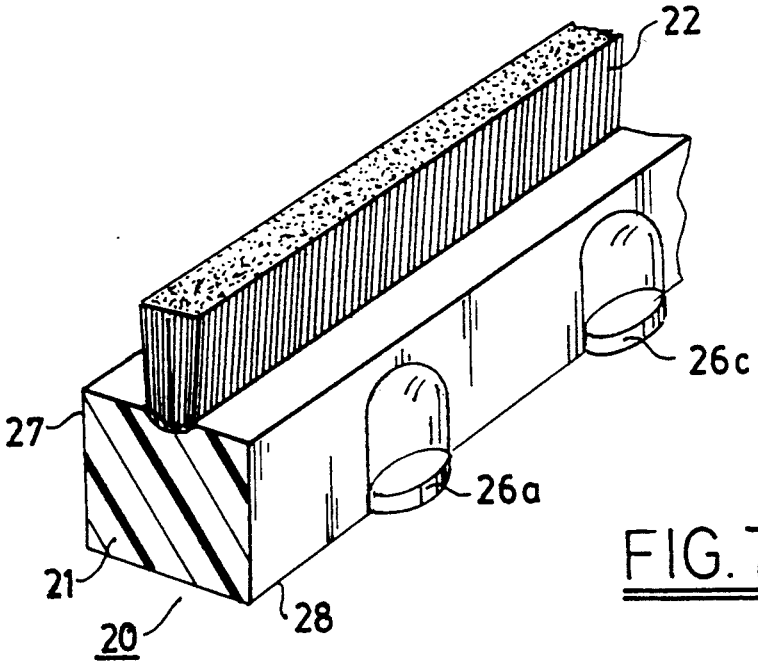
FIG. 7 is a partial perspective view of an alternate embodiment of the invention.

As mentioned above, certain prior assemblies have employed channels that had a T-shape configuration with the crossbar of the T disposed along the base of the channel and the stem of the T extending vertically from the base. As shown in FIG. 7, the weatherstrip 20 can be adapted to fit into such T-shape channels by providing a plurality of nubbins 26 A, B, C, . . . 26 N. Each nubbin 26 is formed along one of the vertical sides 27, 28 of the backing strip 21. The nubbins 26 are formed with a suitable punching tool which deforms a portion of the sidewall 27, 28 to provide a projection 26. Projection 26 extends laterally away from sidewall 28 and has a sufficient height in order to engage the lower surface of the lips of the T-slot.

Figure 8:
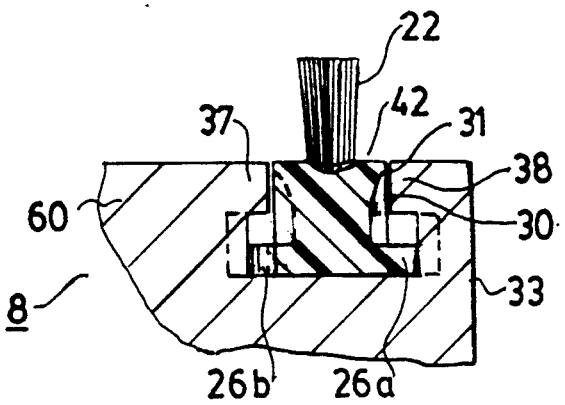
FIG. 8 is a cross-sectional view of FIG. 7.

With reference to FIG. 8, there is shown the weatherstrip assembly 8 in a T-slot 30. The T-slot 30 has a stem or upper portion 31 of a cross-sectional area that is less than the cross-sectional area of a lower or crossbar portion 32. Thus, the T-slot 30 has a pair of lips 37, 38 which project toward one another and define an opening 42. Nubbins 26A, 26B . . . 26N extend from opposite sidewalls 27, 28 of backing strip 21. The lower surface of lips 37, 38 engage and retain the upper surface of nubbins 26B, 26A . . . 26N to thereby maintain the weatherstrip 20 within the channel 30. Pile members 22 extend through the opening 42. In this instance, the window or door 60 or that portion thereof which includes the channel 30 is made up of flexible material. As indicated above, in connection with FIG. 4, the outer wall portion 33 is flexible in a outwardly bending direction in order to expand the upper opening 42 in order to permit the backing strip 21 with its nubbins 26 to be inserted into the T-slot opening 30.

While the foregoing describes the invention and its alternative embodiments, those skilled in the art will understand that further changes, modifications and adaptations may be made to the particular structural elements defined above without departing from the spirit and scope of the invention as set forth in the claims below.

What I claim is:

1. A weatherstrip assembly comprising:

an elongated channel having a rectangular cross-sectional area defined by a base and a pair of walls spaced apart and extending vertically from said base and an opening in said channel opposite said base, wherein at least one of said walls is flexible for temporarily expanding the cross-sectional area of said channel so that a weatherstrip member may be inserted into or removed form said channel, said weatherstrip member providing said weatherstrip assembly when inserted into said channel.

2. The weatherstrip assembly according to claim 1 wherein said cross-sectional area of said backing member is rectangular in shape.

3. The weatherstrip according to claim 2 wherein said rectangular area is a square.

4. The weatherstrip assembly of claim 1 further comprising a plurality of nubbins disposed longitudinally along said backing member and extend laterally therefrom to frictionally engage the walls of said channel.

5. The weatherstrip assembly of claim 4 wherein the channel has an upper portion with a width across the channel that is less than the width across a lower portion of the channel adjacent the base thereby defining a T-shaped cross-sectional area for said channel.

6. The weatherstrip assembly of claim 1 wherein each wall has a lip and each lip is disposed at the opening of the channel and each lip extends in a direction toward said other lip and partially across said channel to form an opening of a width less than the width of said base for retaining said backing member in said channel.

* * * * *